US007771297B2

(12) United States Patent
Kuhn

(10) Patent No.: US 7,771,297 B2
(45) **Date of Patent: *Aug. 10, 2010**

(54) BROADHEAD ARROWHEAD

(75) Inventor: Todd A. Kuhn, North East, MD (US)

(73) Assignee: 2XJ Enterprises, Inc., North East, MD (US)

( * ) Notice: Subject to any disclaimer, the term of this patent is extended or adjusted under 35 U.S.C. 154(b) by 918 days.

This patent is subject to a terminal disclaimer.

(21) Appl. No.: 11/363,450

(22) Filed: Feb. 28, 2006

(65) Prior Publication Data

US 2006/0194658 A1 Aug. 31, 2006

Related U.S. Application Data

(63) Continuation of application No. 10/734,645, filed on Dec. 15, 2003, now Pat. No. 7,037,223, which is a continuation-in-part of application No. 10/178,243, filed on Jun. 25, 2002, now Pat. No. 6,663,518.

(51) Int. Cl.
*F42B 6/08* (2006.01)

(52) U.S. Cl. ..... 473/583; 473/584

(58) Field of Classification Search ..... 473/578, 473/582, 583, 584

See application file for complete search history.

(56) References Cited

U.S. PATENT DOCUMENTS

| | | | | |
|---|---|---|---|---|
| 3,672,677 | A | 6/1972 | Moore | |
| 3,897,062 | A | 7/1975 | Christensen | |
| 4,012,043 | A | 3/1977 | Carella | |
| 4,392,654 | A | 7/1983 | Carella | |
| 4,534,568 | A | 8/1985 | Tone | |
| 4,565,377 | A | 1/1986 | Troncoso et al. | |
| 4,986,550 | A | 1/1991 | Segovia | |
| 5,064,202 | A | 11/1991 | Barner | |
| 5,257,809 | A | 11/1993 | Carrizosa | |
| 5,613,688 | A | 3/1997 | Carella | |
| 5,636,845 | A | 6/1997 | Newnam | |
| 5,897,449 | A | 4/1999 | Roberts et al. | |
| 5,931,751 | A | 8/1999 | Cooper | |
| 6,142,896 | A | 11/2000 | Simo et al. | |
| 6,319,161 | B1 | 11/2001 | Martinez et al. | |
| 6,663,518 | B1 | 12/2003 | Kuhn | |
| 7,037,223 | B2 * | 5/2006 | Kuhn | 473/583 |

OTHER PUBLICATIONS

Compact Disk of six (6) pictures and two descriptive videos of a broadhead arrowhead called the "Borehead." The six (6) pictures are attached.

* cited by examiner

*Primary Examiner*—John Ricci
(74) *Attorney, Agent, or Firm*—Sterne, Kessler, Goldstein & Fox P.L.L.C.

(57) ABSTRACT

Disclosed is a broadhead arrowhead. The broadhead arrowhead includes a ferrule, one end portion of which is tapered to a substantial point. One or more blade assemblies extend outwardly from the ferrule. Each blade assembly has a first substantially planar main surface portion disposed in a plane at least substantially parallel to a longitudinal axis of the ferrule and a second surface portion having a planar region offset at an angle to the plane of the main surface portion. A generally continuously curved region is disposed between and connecting the first and second substantially planar portions, such that the blade assembly has an airfoil-type shape.

15 Claims, 7 Drawing Sheets

BROADHEAD ARROWHEAD

CROSS-REFERENCE TO RELATED APPLICATIONS

This is a continuation of U.S. patent application Ser. No. 10/734,645, filed Dec. 15, 2003, which is a continuation-in-part of U.S. patent application Ser. No. 10/178,243, filed Jun. 25, 2002, the disclosure of which is incorporated herein by reference as though set forth in full below in the entirety.

BACKGROUND OF THE INVENTION

Field of the Invention

This invention relates to arrows and arrowheads. More particularly, the invention relates to arrowheads of the type commonly referred to as "broadhead" arrowheads typically, but not exclusively, used by hunters.

DETAILED DESCRIPTION OF THE INVENTION

Figure 1:
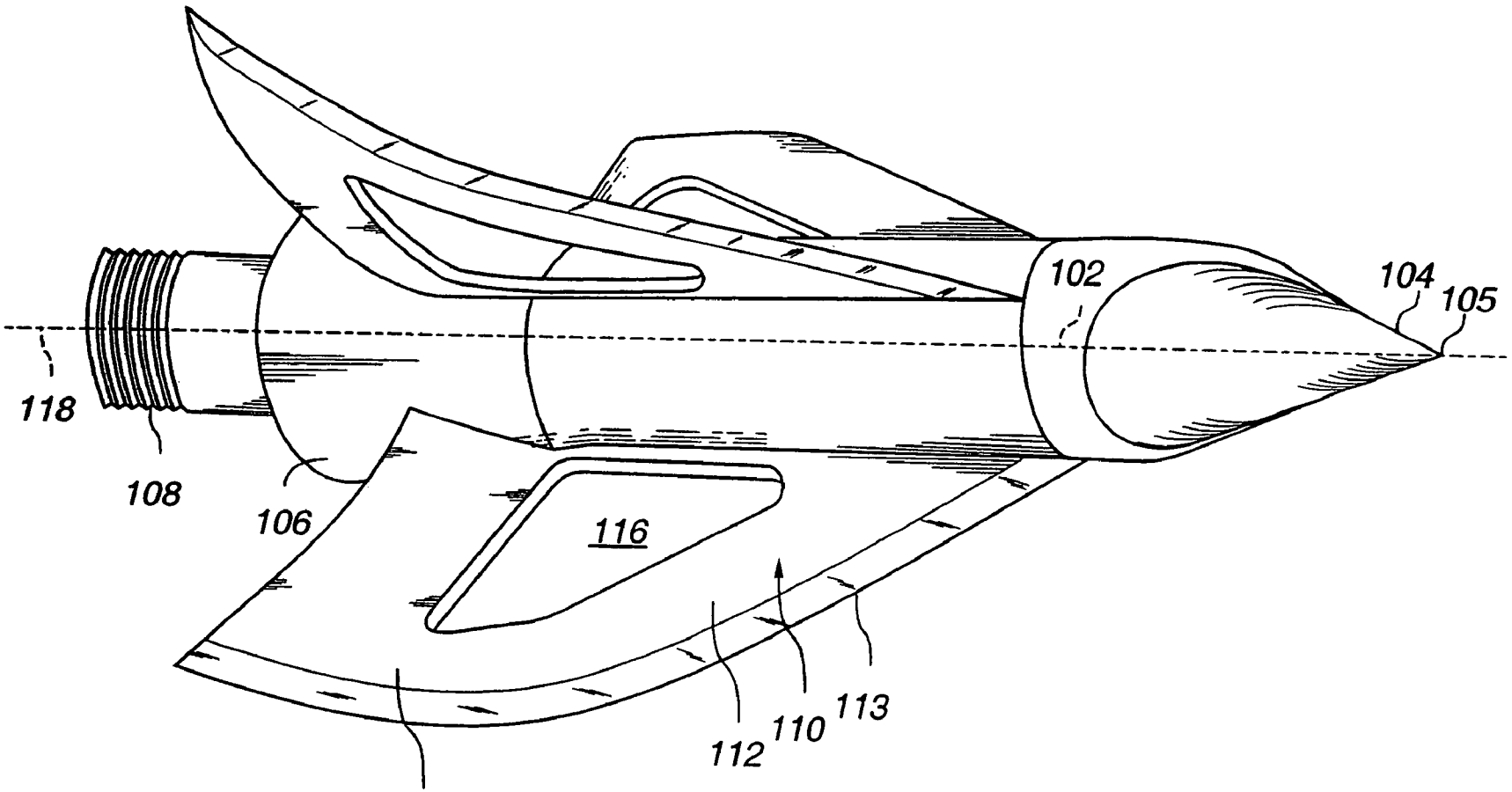
FIG. 1 shows a side perspective view of the broadhead arrowhead of this invention.

Referring to the drawings, the broadhead arrowhead of this invention comprises a body or ferrule 102. At one end, called, for convenience, the proximal end, ferrule 102 incorporates a first, or head, end portion 104. End portion 104 typically tapers to a point 105. Ferrule 102 also has second, or distal, end portion 106. End portion 106 may be slightly flared outwardly. It is not necessary that end portion 106 be flared outwardly. In some embodiments, end portion 106 may continue substantially straight to the rear end of body 102. Ferrule 102 is typically symmetrical about a longitudinal axis 118 between first end portion 104 and second end portion 106.

A mounting stub 108 extends rearwardly from distal end portion 106 of arrowhead body 102. Typically, stub 108 is symmetrical about and coaxial with longitudinal axis 118. Mounting stub 108 is intended to fit into a mating recess typically located at one end of a standard arrow shaft. Stub 108 may be threaded to mate with matching threads in the arrow shaft recess or it may be seated in the recess in a press fit arrangement. Alternatively, mounting stub 108 may be glued or otherwise sealed into the mating recess of the arrow shaft.

In other variations of mounting means, instead of a stub 108, distal end 106 of ferrule 102 may be hollowed out to fit over an arrow shaft. In such an arrangement, the inside of hollow distal end 106 may be threaded to mate with threads on the outer suface of the arrow shaft; or distal end 106 may be press fit over the arrow shaft. Alternatively, distal end 106 may be fitted over the end of the arrow shaft and glued or otherwise sealed to the arrow shaft.

One or more blade assemblies 110 extend laterally outwardly from ferrule 102. Preferably the arrowhead is constructed with two, three or four blade assemblies. Typically, if two blade assemblies are used, they are disposed substantially diametrically opposite each other about longitudinal axis 118 of ferrule 102. Three blade assemblies are typically disposed at angles of approximately 120° around longitudinal axis 118. Correspondingly, four blade assemblies 110 are typically mounted at 90° angles relative to each other about horizontal axis 118.

Figure 4A:
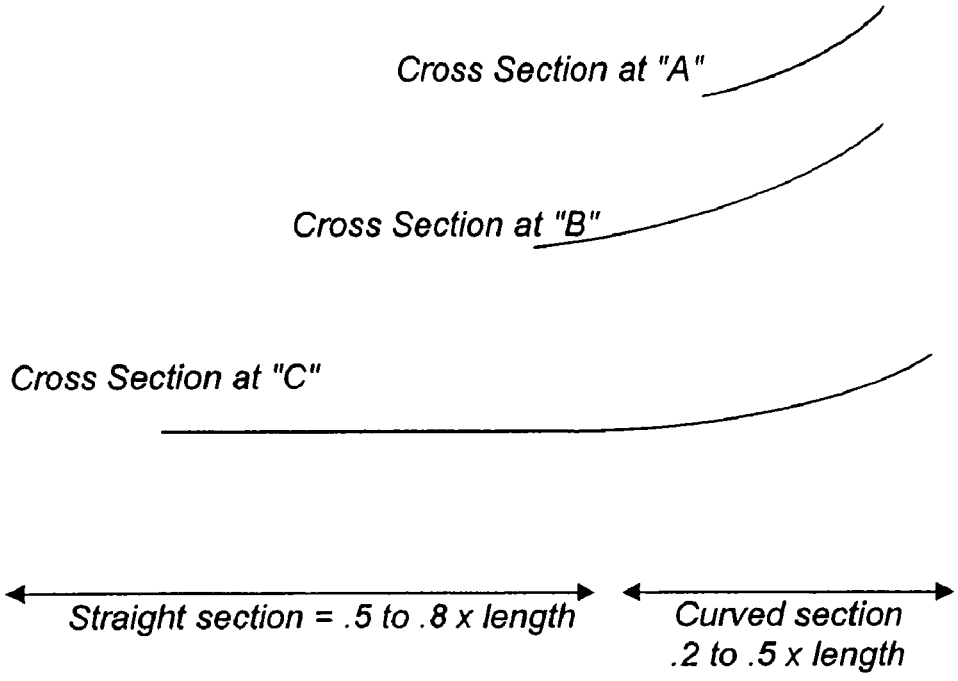
FIG. 4A shows the curvature of the blade assembly at three sections taken along section lines "A-A", "B-B", "C-C", respectively, in FIG. 4.
Figure 4:
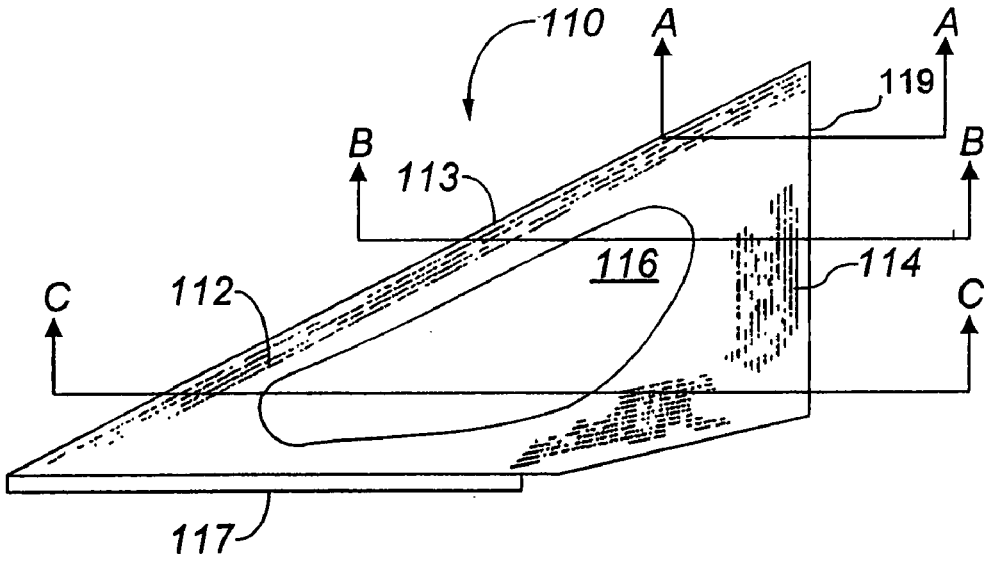
FIG. 4 shows a detailed view of one of the blade assemblies of the arrowhead.

Blade assembly 110 is shown in detail in FIGS. 1 and 4. Each blade assembly 110 comprises a first substantially planar blade assembly portion 112 and a second blade assembly portion 114. A leading edge 113 of first portion 112 is typically sharpened to better allow the arrowhead to penetrate a target. First blade assembly portion 112 may comprise a solid substantially flat planar portion or optionally may have a cutout section 116. Second blade assembly portion 114 extends rearwardly from first blade assembly portion 112. Second blade assembly portion 114 is preferably curved, with a radius of curvature optimally between about 0.2" and 0.5", giving the blade the characteristics of an airfoil. The radius of curvature may vary over the surface of the blade. A trailing edge 119 of the blade is at an angle to arrowhead body 102. This angle may be as great as 45 degrees or more, but optimally it increases from approximately 5 degrees to approximately 35 degrees at the blade tip. The blades, acting together, form an axial-flow turbine.

Figure 3:
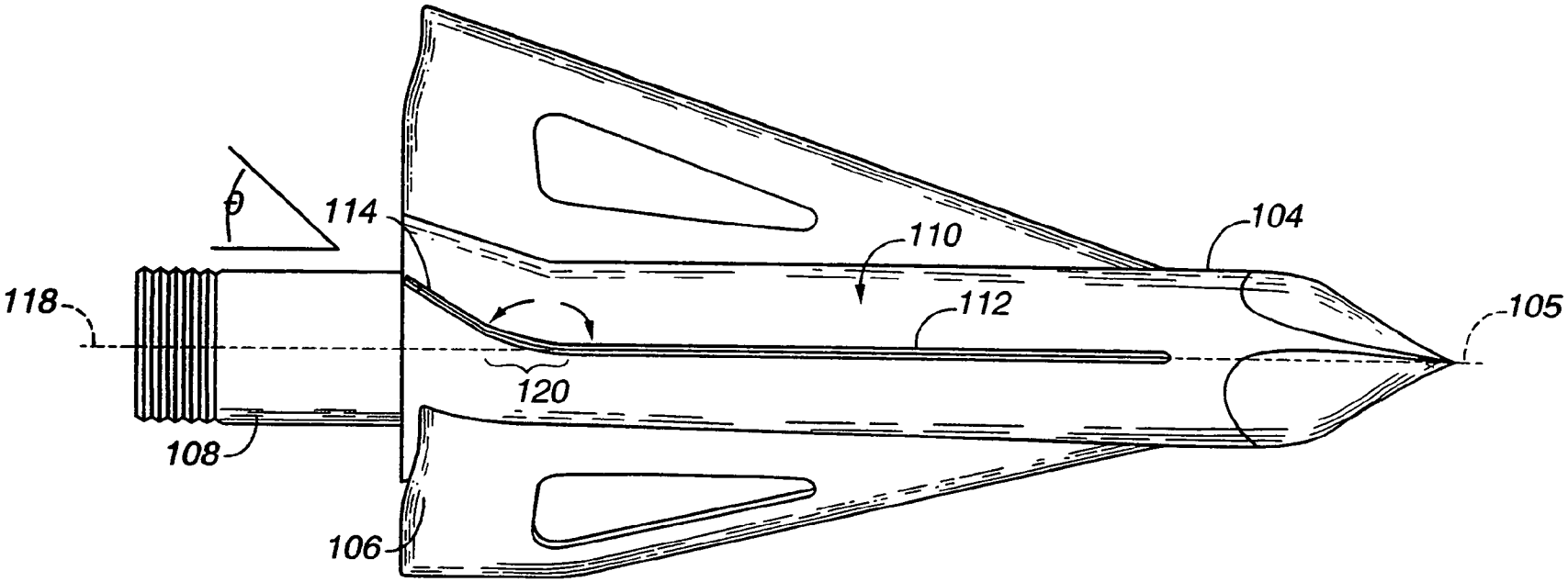
FIG. 3 shows a side detail view of the arrowhead.

As shown in FIG. 3, second blade assembly portion 114 is joined to first blade assembly portion 112 by a continuously curved region 120. The radius of curvature of region 120 is in the range of between about 0.2" and 0.5". An angle θ generally defines the angle between first planar portion 112 and second planar portion 114. This angle θ is in the range of between about 5° and 25°. This configuration gives the blade assembly an airfoil-type shape. The length of first substantially planar portion 112 is between about 50% and 80% of the total length of blade assembly 110. Correspondingly, second substantially planar portion 114 comprises between about 20% and 50% of the total length of blades assembly 110.—It will be understood by those skilled in the art that where the arrowhead has more than one blade assembly 110, each blade assembly portion 114 is preferably angled relative to each corresponding blade assembly portion 112 in the same direction and at substantially the same angle for each blade assembly 110.

Alternatively, first planar portion 112 and second angled planar portion 114 may be joined at a more sharply defined angle θ with a radius of curvature close to or at "0". However, this alternative configuration does not produce the same high quality of aerodynamic effects as does the airfoil shape shown in FIG. 3.

FIG. 4A shows the curvature of the blade assembly 110 at three sections taken along section lines "A-A", "B-B", "C-C", respectively, in FIG. 4.

Arrowhead body 102 and blade assemblies 110 may be made of any suitable material, such as, but not limited to, steel, aluminum, plastic, etc. As shown in FIG. 4, planar portion 112 of blade assembly 110 has a short extension 117 that fits into a slotted opening in ferrule 102. Extension 117 extends from the inner edge of planar portion 112 substantially up to but just short of curved region 120. Extension 117 may be glued, welded or soldered to the slot in body 102. Alternatively, blade assembly 110 and body 102 may be integrally formed as by molding. Other techniques for securing blade assembly 110 to body 102 would be apparent to those skilled in the relevant arts.

Figure 2:
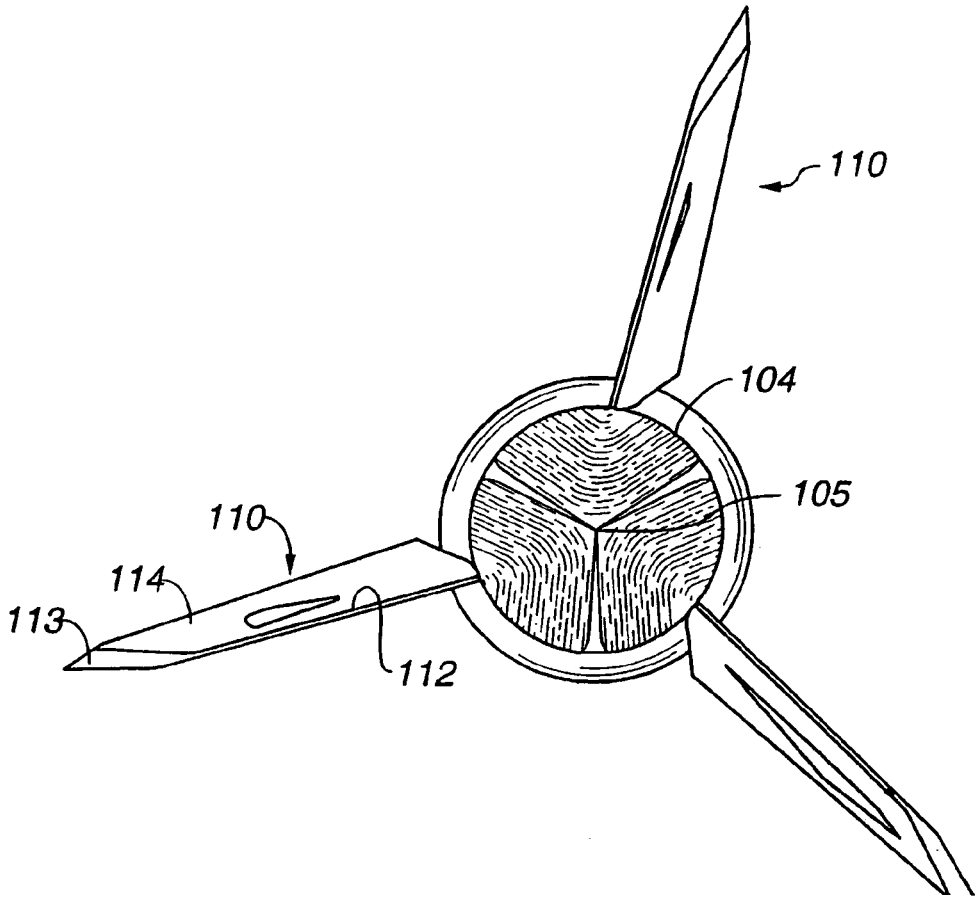
FIG. 2 shows an end view of the broadhead arrowhead looking rearwardly from the forward end of the arrowhead.

In summary, each blade assembly 110 comprises a substantially flat planar portion 112 extending laterally outwardly of body 102 and substantially parallel to longitudinal axis 118. A second blade assembly portion 114 is angled at an angle of between about 5° and 25° out of the plane of section 112 away from alignment with axis 118 and at an angle of between about 5° and about 45° to the ferrule body 102. FIG. 2 shows end portions 114 of each blade angled slightly clockwise relative to the major plane of section 112. Alternatively, end portions 114 can be angled slightly counterclockwise relative to the major plane of section 112.

In the embodiment shown, each blade assembly 110 has the general shape of a substantially triangular or delta wing configuration. In other embodiments, blade assembly 110 can have the general shape of a swept wing or straight wing.

Much like the control surfaces of an aircraft wing, the ratio of angled portion length to overall blade assembly length can be relatively small. For example, in one embodiment, the ratio of the length of angled portion 114 to the overall length of blade assembly 110 is in the range of between 10% and 50%, and preferably between about 20% and 50%.

Each blade of the broadhead arrowhead incorporates a substantially similar airfoil that produces a rotational torque about longitudinal axis 118. In flight, these forces induce a rapid rotation of the arrow about longitudinal axis 118 while minimizing aerodynamic drag. The plane of each blade assembly 110 remains parallel to the shaft of the arrow along its cutting edge 113.

Figure 5:
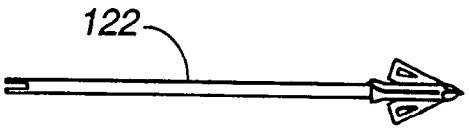
FIG. 5 shows the broadhead arrowhead mounted to an arrow shaft.

One of the features of the arrowhead of this invention is its ability to produce stabilized arrow flight without the use of fletching or tail fins (or feathers). FIG. 5 shows the broadhead arrowhead of this invention mounted to an arrow shaft 122 without fletching. Tests have shown that an arrow using the broadhead of this invention without fletching tracks true in flight and does not deviate significantly from the planned flight course. This is due to the rotation induced in the arrow by the aerodynamically designed broadhead blades, which is sufficient to stabilize the arrow in flight. Eliminating the fletching in fact improves flight characteristics because the rotational drag normally induced by the fletching is avoided. It should be noted, however, that the arrowhead of the invention can be used with fletched arrow shafts, as well.

Figure 6:
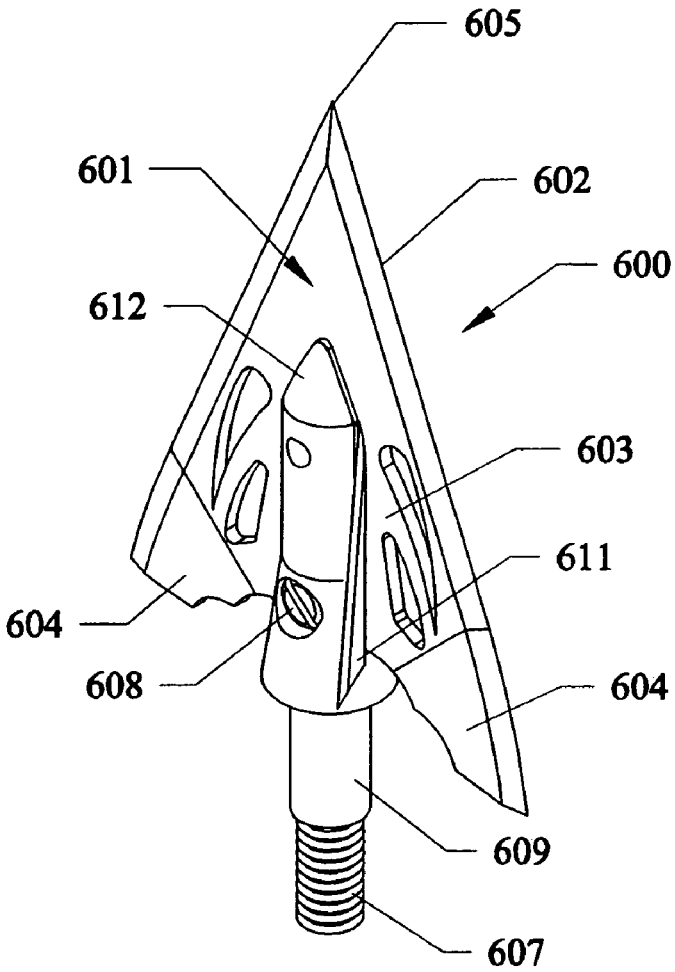
FIG. 6 shows a side perspective of an alternate embodiment of the broadhead arrowhead.
Figure 7:
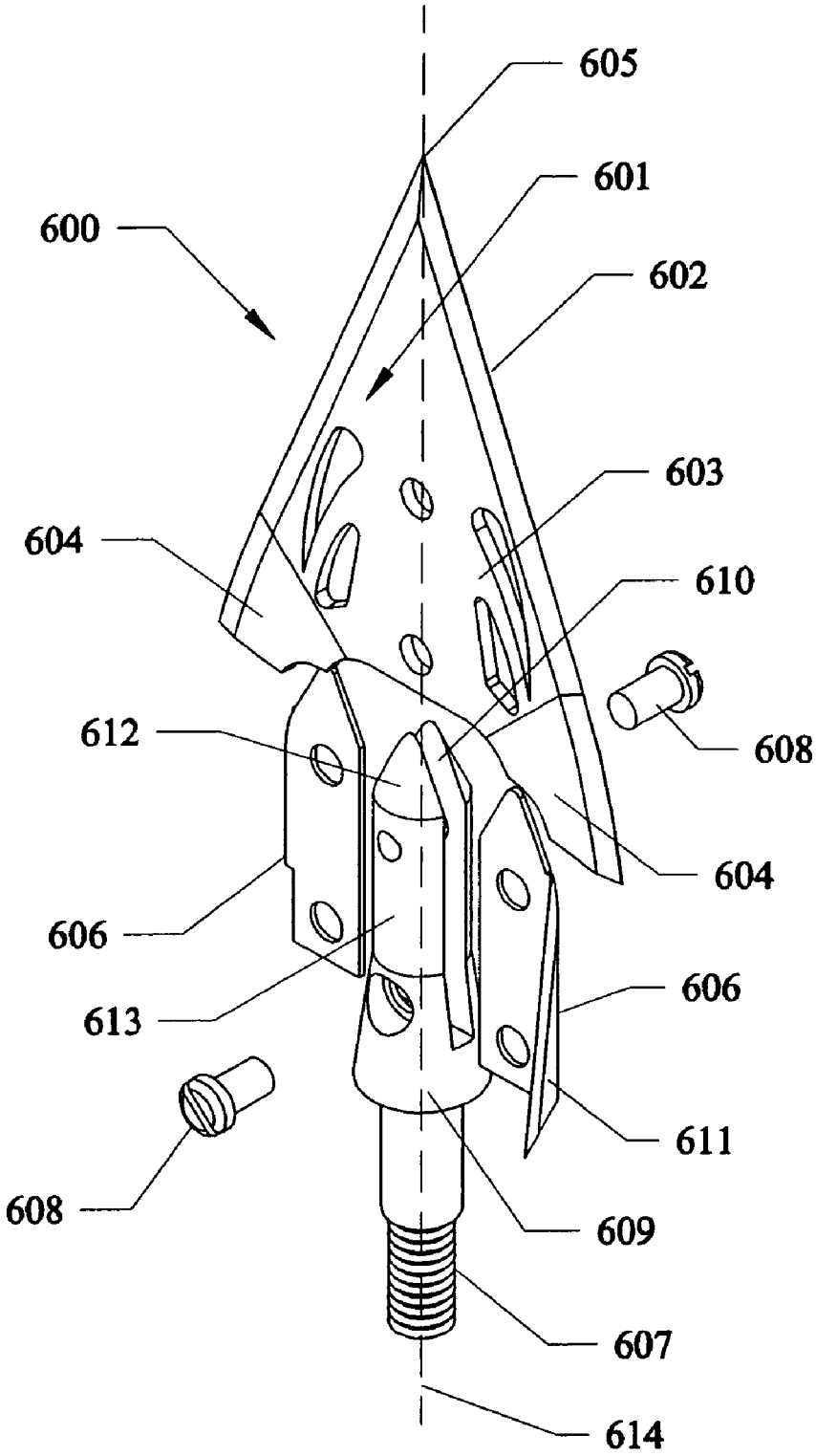
FIG. 7 shows a detail view of the alternate embodiment of the broadhead arrowhead.
Figure 8:
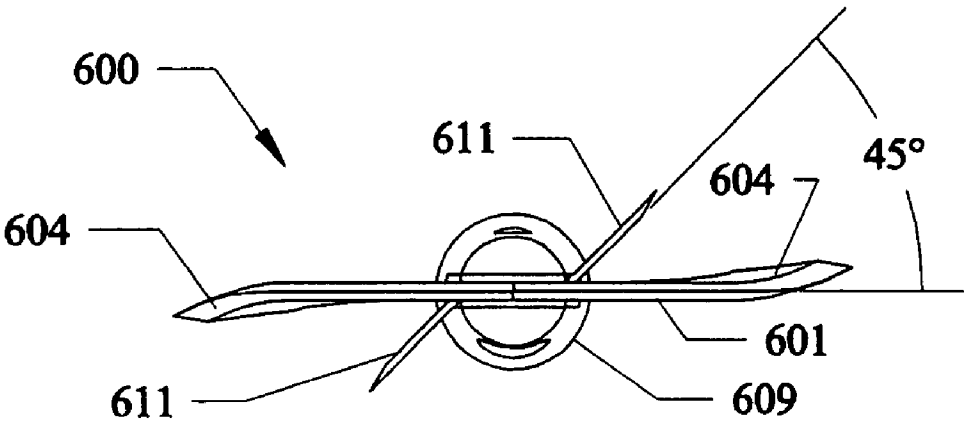
FIG. 8 shows a front view of the alternate embodiment of the broadhead arrowhead.

A further embodiment of the broadhead of this invention comprises a single blade that provides a similar function as two independent assemblies. As shown in FIGS. 6-8, a broadhead arrowhead 600 comprises a body or ferrule 613. At a first, or proximal, end 612, ferrule 613 incorporates a longitudinal slot 610 or other means for the purpose of mechanically securing a blade assembly 601 and up to two optional bleeder blades 606. Ferrule 613 also has a second, or distal, end portion 609. Second end portion 609 may be slightly flared outwardly. It is not necessary that second end portion 609 be flared outwardly, however. In some embodiments, second end portion 609 may continue substantially straight to the rear end of body 613. Ferrule 613 is typically symmetrical about a longitudinal axis 614 between first end portion 612 and second end portion 609.

A mounting stub 607 extends rearwardly from second end portion 609 of arrowhead body 613. Typically, stub 607 is symmetrical about and coaxial with longitudinal axis 614. Mounting stub 607 is intended to fit into a mating recess typically located at one end of a standard arrow shaft. Stub 607 may be threaded to mate with matching threads in the arrow shaft recess or it may be seated in the recess in a press fit arrangement. Alternatively, mounting stub 607 may be glued or otherwise sealed into the mating recess of the arrow shaft.

In other variations of mounting means, instead of a stub 607, second end 609 of body 613 may be hollowed out to fit over an arrow shaft. In such an arrangement, the inside of hollow second end 609 may be threaded to mate with threads on the outer surface of the arrow shaft; or distal second end 609 may be press fit over the arrow shaft. Alternatively, second end 609 may be fitted over the end of the arrow shaft and glued or otherwise sealed to the arrow shaft.

Blade assembly 601 extends laterally outwardly from ferrule 613 in two directions diametrically opposite each other about longitudinal axis 614 of ferrule 613 and disposed in a plane at least substantially parallel to the longitudinal axis of ferrule 613. Blade assembly 601 comprises a first substantially planar blade assembly portion 603 and two second blade assembly portions 604. The leading edge 602 of first portion 603 is typically sharpened to better allow the arrowhead to penetrate a target. First blade assembly portion 603 may comprise a solid substantially flat planar portion or optionally may have one or more cutout sections. Two second blade assembly portions 604 extend rearwardly from first blade assembly portion 603 at an angle thereto. Second blade assembly portion 604 is preferably continuously curved, with a radius of curvature optimally between about 0.2" and 0.5", giving the blade the characteristics of an airfoil. The radius of curvature may vary over the surface of the blade in a compound angle such that each trailing edge of the second portion 604 is at an angle to arrowhead body 613 and at an angle to first portion 603. This angle may be as great as 45 degrees or more, but optimally it increases from approximately 5 degrees to approximately 35 degrees at the blade tips and most optimally increases from approximately 5 degrees to approximately 25 degrees at the blade tips. Second blade assembly portions 604 are angled out of the plane of first assembly portion 603 in opposing directions as shown in FIG. 8. The two second portions 604, acting together, form an axial-flow turbine in the same manner as would two blade assemblies 110 described above. It will be understood by those skilled in the art that each second blade assembly portion 604 is preferably angled relative to first blade assembly portion 603 in the same rotational direction and at substantially the same angle.

FIG. 8 shows second end portions 604 of each blade angles slightly counterclockwise relative to the major plane of first planar portion 603. Alternatively, second end portions 604 can be angled slightly clockwise relative to the major plane of first planar portion 603.

The length of first substantially planar portion 603 is between about 50% and 80% of the total length of blade assembly 601. Correspondingly, second substantially planar portion 604 comprises between about 20% and 50% of the total length of blade assembly 601.

Alternatively, first planar portion 603 and second angled portion 604 may be joined at a more sharply defined angle θ with a radius of curvature close to or at "0". However, this alternative configuration does not produce the same high quality of aerodynamic effects as does the airfoil shape shown in FIG. 7 and FIG. 8.

Arrowhead body 613 and blade assembly 601 may be made of any suitable material, such as, but not limited to, steel, aluminum, plastic, etc. As shown in FIG. 7, first planar portion 603 of blade assembly 601 fits into a slotted opening 610 in body 613. First portion 603 may be glued, welded, soldered, or otherwise mechanically attached into the slot 610 of body 613. FIG. 7 shows a pair of screws 608 used to provide this attachment means. The use of screws permits easy blade replacement in the field. Alternatively, blade assembly 601 and body 613 may be integrally formed as by molding. Other techniques for securing blade assembly 601 to body 613 would be apparent to those skilled in the relevant arts.

In the embodiment shown, blade assembly 601 has the general shape of a substantially triangular or delta wing configuration. In other embodiments, blade assembly 601 can have the general shape of a swept wing or a straight wing.

Much like the control surfaces of an aircraft wing, the ratio of angled portion length to overall blade assembly length can be relatively small. For example, in one embodiment, the ratio of the length of angled second portion 604 to the overall length of blade assembly 601 is in the range of between 10% and 50%, and preferably between about 20% and 50%.

One of the features of all embodiments of the arrowhead of this invention is its ability to produce stabilized arrow flight without the use of fletching or tail fins (or feathers). All embodiments of the arrowhead of the invention can be used with fletched arrow shafts as well.

An optional feature of the present invention is the inclusion of one or two bleeder blades 606. For aerodynamic symmetry, two bleeder blades 606 are preferably employed. Each bleeder blade includes a second bleeder blade portion 611 which is disposed at an angle θ' relative to the main plane of blade assembly 601 as shown in FIG. 8. Angle θ' is preferably in the range between 30 and 70, but preferably in the range between 45 and 60 degrees. Bleeder blades 606 may be attached to body 613 by any means common in the art. FIG. 7 depicts bleeder blades 606 attached mechanically using the same screws 608 that are used to attach blade assembly 601.

The overall size of bleeder blade 606 is greatly reduced relative to the size of blade assembly 601. As with other broadhead designs, bleeder blades 606 of the present invention are meant to inflict additional damage to the target without substantially reducing overall penetration depth as may be the case if additional blades of similar or identical size to the main blade assembly 601 were included in the design. Smaller blades still cut, but their friction with the wound is reduced.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A broadhead arrowhead, comprising:

a body having a longitudinal axis;

a blade assembly coupled to and extending outwardly from the body;

the blade assembly having a first substantially planar portion disposed in a plane at least substantially parallel to the longitudinal axis of the body and a second portion located at the rear end portion of the first planar portion in the direction of motion of the arrowhead and disposed at an angle to the plane of the first planar portion; and a curved region disposed between and connecting the first and second portions, wherein the blade assembly has an airfoil-type shape that enables the arrowhead to rotate about the longitudinal axis in flight.

2. An arrowhead according to claim 1, further comprising a plurality of blade assemblies disposed substantially symmetrically around the longitudinal axis of the body.

3. An arrowhead according to claim 2, further comprising at least three blade assemblies disposed substantially symmetrically around the longitudinal axis of the body spaced at angles of approximately 120° from each other.

4. An arrowhead according to claim 3, wherein one end portion of the body is tapered substantially to a point.

5. An arrowhead according to claim 2, further comprising means for mounting the arrowhead to an arrow shaft.

6. An arrowhead according to claim 5, wherein the arrowhead mounting means comprises a stub member extending from one end of the body substantially coaxial with the longitudinal axis of the body.

7. An arrowhead according to claim 6, wherein the stub member is threaded to mate with matching threads on an arrow shaft.

8. An arrowhead according to claim 2, wherein the second portion has a length of between about 20% and 50% of the overall length of the blade assembly.

9. An arrowhead according to claim 2, wherein the curved region has a radius of curvature of between about 0.2" and 0.5".

10. An arrowhead according to claim 2, wherein the second portion has a trailing edge region disposed at an angle to the body.

11. An arrowhead according to claim 10, wherein said trailing edge region is disposed at an angle to the body in the range of about 5 degrees and about 45 degrees.

12. An arrowhead according to claim 11, wherein said trailing edge region is disposed at an angle to the body in the range of about 5 degrees and about 35 degrees.

13. A broadhead arrow, comprising:

a shaft having a longitudinal axis;

a body having a longitudinal axis mounted to one end portion of the shaft such that the longitudinal axis of the body is coincident with the longitudinal axis of the shaft;

a blade assembly coupled to and extending outwardly from the body;

the blade assembly having a first substantially planar portion disposed in a plane at least substantially parallel to the longitudinal axis of the body and a second portion located at the rear end portion of the first planar portion in the direction of motion of the arrowhead and disposed at an angle to the plane of the first planar portion; and a curved region disposed between and connecting the first and second portions, wherein the blade assembly has an airfoil-type shape that enables the arrowhead to rotate about the longitudinal axes of the body and shaft in flight.

14. A broadhead arrow according to claim 13, further comprising fletching coupled to a second end portion of the shaft spaced from the one end portion.

15. A broadhead arrow according to claim 13, wherein the shaft is devoid of fletching.

* * * * *